United States Patent [19]

Bassetti

[11] Patent Number: 4,642,826

[45] Date of Patent: Feb. 17, 1987

[54] REMOVABLE LININGS FOR SNUGLY WRAPPING TRIDIMENSIONAL ARTICLES

[75] Inventor: Piero Bassetti, Milan, Italy

[73] Assignee: Bassetti S.p.A., Milan, Italy

[21] Appl. No.: 565,455

[22] Filed: Dec. 27, 1983

[30] Foreign Application Priority Data

Jan. 6, 1983 [IT] Italy ..... 19019 A/83

[51] Int. Cl.[4] ..... A47G 9/02; A47G 9/04

[52] U.S. Cl. ..... 5/496; 5/497

[58] Field of Search ..... 5/494–499

[56] References Cited

U.S. PATENT DOCUMENTS

| | | | |
|---|---|---|---|
| 2,886,833 | 5/1959 | Enger | 5/496 |
| 3,321,782 | 5/1967 | Hrubecky et al. | 5/497 |
| 3,638,252 | 2/1972 | Palenske | 5/497 |
| 3,694,832 | 10/1972 | Jamison | 5/497 |

FOREIGN PATENT DOCUMENTS

| | | | |
|---|---|---|---|
| 1218393 | 1/1971 | United Kingdom | 5/496 |

*Primary Examiner*—Alexander Grosz
*Assistant Examiner*—Michael F. Trettel
*Attorney, Agent, or Firm*—Morgan & Finnegan

[57] ABSTRACT

This invention relates to a method for manufacturing removable linings to snugly wrap articles having a tridimensional outline. Such a method, which starts from a roll of fabric, of a nonwoven fabric, knitted fabric, meshed fabric and other fabrics, manufactures such linings continuously through a sequence of operations which are carried out in orderly marshalled stations.

The finished linings thus obtained has, on the end folds of at least one of two opposite sides, a crease of the same folds sewn in the vicinity of the two nonfolded sides of the fabric piece.

An additional and preferred embodiment exhibits corrugation members which can slide within seatings formed by an edging, said edging and said corrugation members being, in their turn, enclosed within the crease of said folds.

9 Claims, 6 Drawing Figures

REMOVABLE LININGS FOR SNUGLY WRAPPING TRIDIMENSIONAL ARTICLES

This invention relates to a method for manufacturing removable linings which are capable of snugly receiving tridimensional articles; a lining can considered to be, for example, a bed sheet, a protective lining for a mattress (under the sheet) or a lining for the upholstery of sofas and archairs and so forth. Methods are known, such as that illustrated by the U.S. Pat. No. 4,370,939 of 1/2/83 wherein, starting from a fabric roll, one obtains, at the outset, pieces having a preselected size.

The corners of the pieces in question are cut away so as to provide four folds which are arranged one on each side and such that, by transversally sewing the confronting and adjoining edges a lining can be formed which has a substantially parallelepipedal configuration.

In specially provided peripherally sewn curls, there are finally inserted, in registry with the four corners defined as aforesaid, resiliently stretchable members so as to make it possible to apply the lining stably while concurrently permitting the easy withdrawal of the lining.

A parallelepipedal lining having a resilient angular zones for fastening of the kind referred to above, however, originates a host of problems both from the point of view of the construction and upkeep and practical use.

The constructional problems stem from the circumstance that in a preliminary stage one has to prepare the strips with the cutaway corners, whereafter the strips are to be sewn on the four corners individually and only at that time it becomes possible to apply the elastic edging in registry with the angular zones.

To obtain that, the sewing machine must be fitted with device for guiding the free edge, devices for detecting the transversal seams, devices for inserting the resilient member and for cutting it.

Upstream of the means listed above additional means should be provided for snipping the corners out of the fabric pieces, the latter being superposedly positioned in a certain number by a mechanism or an attendant so as to unroll them from their roll and to sever them out of same.

Upkeep problems are originated by cloth-hanging pressing folding and storage, which are eminently felt in the industrial field, in which, for linings of the conventional outline these operations are made automatically by pressing and folding machinery.

The principal objective of the present invention is to provide a method for making such removable linings so that one is enabled to start from a roll of fabric or nonwoven fabric and, by an entirely continuous run and in a cascade-like sequence of steps, a quite correctly folded lining can be obtained.

An additional obejct is to provide an article which does not originate the motley crew of constructional use and upkeep problems referred to in the foregoing.

Having these objectives in view, according to the basic ideas of the present invention, it has been envisaged to provide a method for the continuous manufacture of linings starting from a roll of a woven or nonwoven fabric, said method being characterized in that it involves the stepwise forward motion of a strip of fabric unrolled from said roll through processing stations in which the following processing stages are performed:

a folding down of extreme edges upon themselves and transversal sewing along a generally V-shaped seamline having its apex pointing towards the interior of the fabric and terminated in correspondence with the folded down edges;

a transversal cut of the fabric along a line which conjoins said apexes;

a trimming of the cut fabric edges, and a folding and packaging of the articles thus obtained.

A lining as obtained according to the method outlined above is characterized in that it comprises on extreme folds of at least one of two opposite sides, a folding of the edges sewn in the vicinity of the two nonfolded sides of the fabric piece. Preferably, such a method also comprises the following steps:

applying to the longitudinal edges respective cord-like members for corrugating the fabric, and edging the borders on said corrugation members so as to provide a tubular sheath of said members so as to hold them.

These two operations are preferably, but not compulsorily, carried out upstream of the previously enumerated steps.

A lining of the kind described preferably has corrugation members on the extreme folds of at least one of two opposite sides, said members being slidable within sheaths provided by edging, said edging and said corrugation members being, in their turn, enclosed within the fold of said edges as sewn in the vicinity of the two nonfolded sides of the piece.

In order to facilitate the understanding of the features and the advantages of the method and the article according to the present invention, an example is given herein of them, with reference to the diagrammatical drawings forming a part of this specification, wherein:

FIG. 1 diagrammatically shows the stages through which the method according to this invention is carried out, in which, starting from a fabric roll, one obtains a finished lining which is quite correctly folded in plan.

Figure 1:
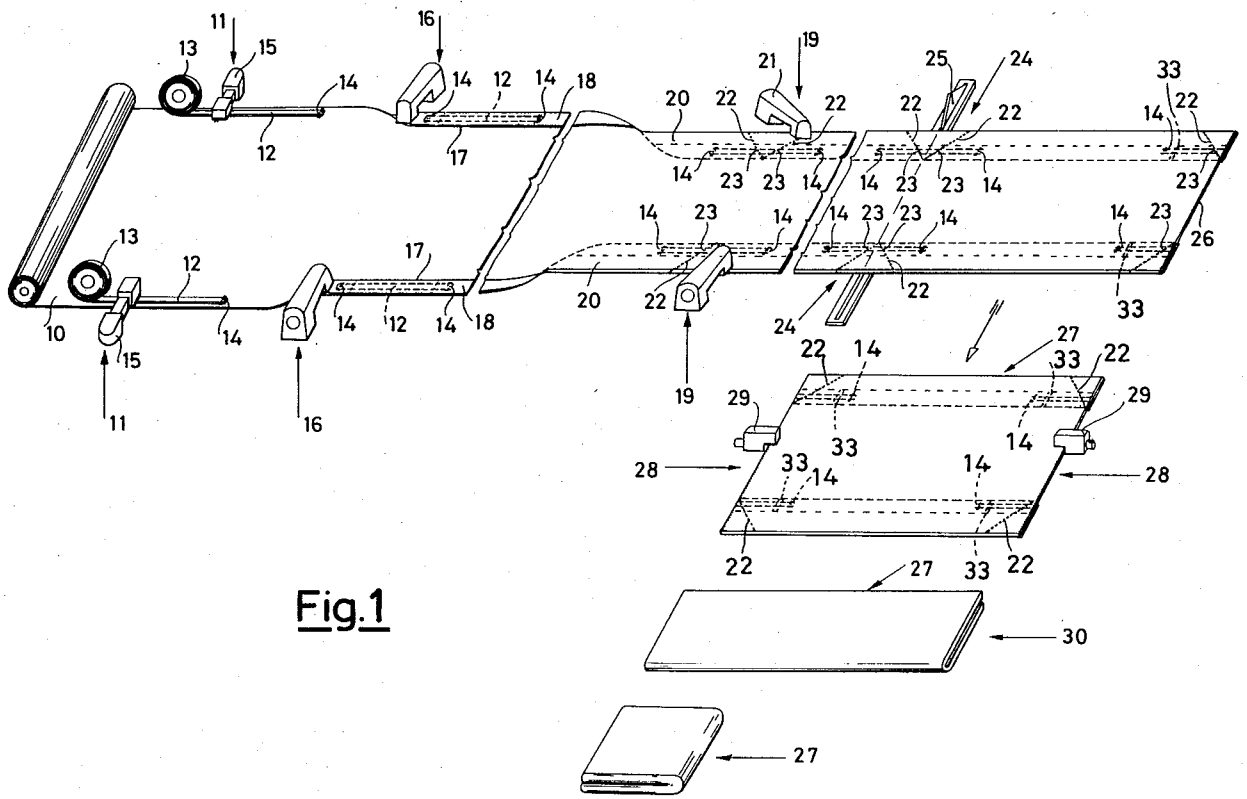

With reference to FIG. 1, a fabric wound on a roll, indicated at 10, is fed to a station 11 for application of a resilient member 12, which can be pulled out, for example, from two sideway dispensers 13.

The stretchable member 12 is applied, longitudinally, in a preselected length, onto the fabric 10 and is sewn transversally at its two ends 14 by sewing and cutting machinery 15.

At a subsequent processing station 16, for example by baffling means (not shown to simplify the showing) the marginal edges of the fabric 10 are folded down onto the elastic band which has already been applied and a seamline 17 of the edges defines an edging 18 as a sliding sheath for the stretchable members 12 as such.

At a station 19 a folding down 20 is caused to occur of the longitudinal edges of the piece, which are folded onto themselves widely enough so as to enclose also the edging 18 or the sliding sheath for the stretchable members 12, or of non-resilient cords for corrugating the fabric.

Second sewing machinery 21 provide an angular sewing seam 22, which sets the fold 20 in position together with the stretchable member 12 at two spots 23.

The fabric goes ahead its way and reaches another station 24, in registry with specially provided severing means 25.

The transversal sever 26 of the fabric 10 is carried out along a line passing through the apexes of two angular seamlines 22 placed confrontigly on two opposite sides of the fabric. Thus, a lining is provided, indicated generally at 27 and which, shifted laterally, is then brought to a station 28 whereas transversale sewing machinery 29 effects the finishing of the warp threads along the severing lines 26, so that the lining 27 is completed.

At the last station 30, appropriate folding machinery (not shown in the drawings) provide to fold the lining 27 so that the latter is in readiness for being packaged and stored.

The sequential order of the processing steps as described above by way of example only and without limitation can also be modified. For example, immediately on completion of the application of the elastic band, the fabric can be severed and sent, after having been angularly shifted through 90°, to the subsequent folding and sewing stages. Likewise, the application of the elastic band can also follow the severing operation and can be perpendicular to the direction of feed of the processing line.

Devices for controlling and actuating the several processing stations are provided and such devices can be of any optical, mechanical and electronic type.

In actual practice, photoelectric cells will be used, devices which count the stitches applied by the sewing machinery and devices which measure the fabric thickness as the fabric slides beneath appropriate feelers, so as to generate and to deliver to electronic counters the signal to energize or to deactivate the operative members which are present in the several stations.

Figure 2:
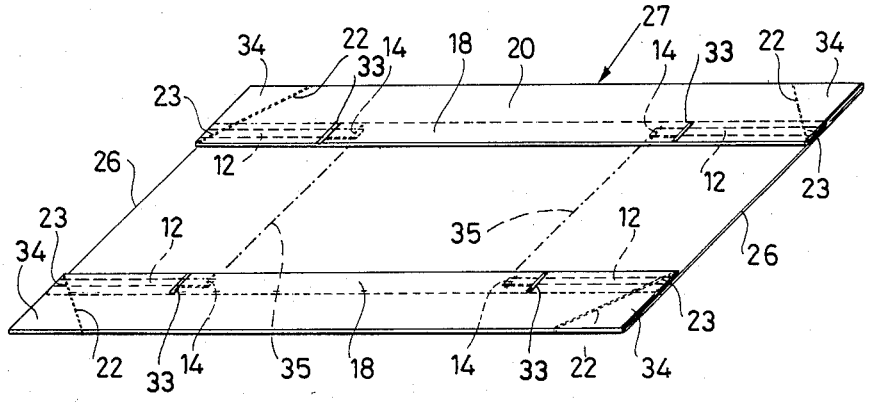
FIG. 2 shows a lining made according to this invention as finished and laid on a planar surface.

A lining 27 obtained in this way has, prior to being folded, the appearance shown in FIG. 2 and, more detailedly:

The fabric piece 10 appears to be transversally cut along the lines 26 and is trimmed thereat and, perpendicularly to the lines 26 it has two end folds 20.

In correspondence with the four corners, there are seamlines 22 which are transversal to such angles and which latch, at 23, either end of the stretchable member 12, to the other end being stitched at 14.

Figure 3:
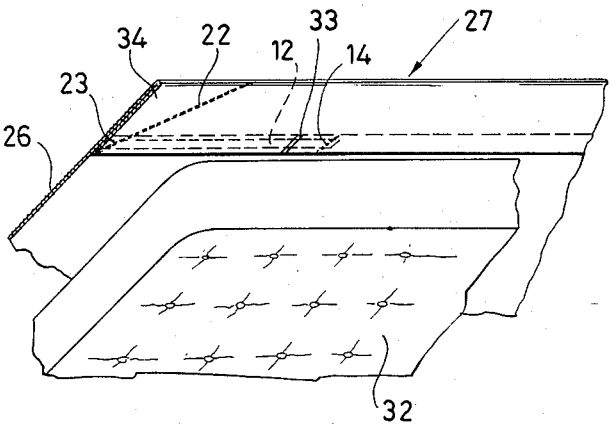
FIGS. 3, 4 and 5 show the stages of placing such a lining onto a mattress.
Figure 4:
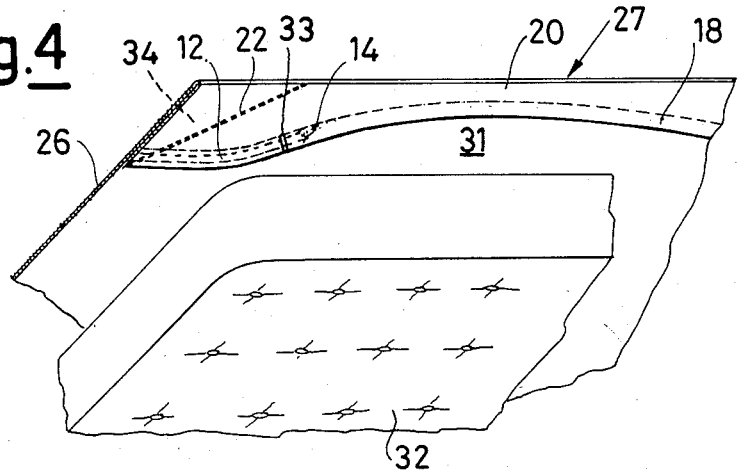
Figure 5:
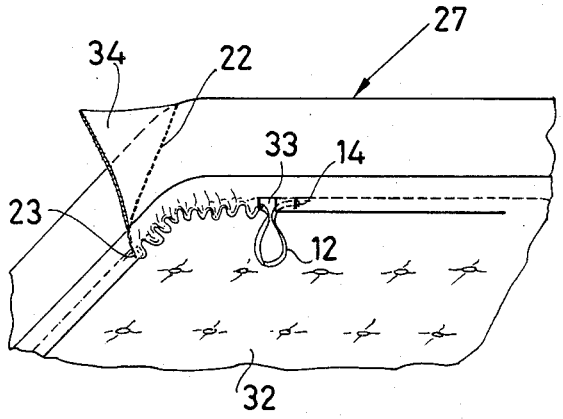

Each fold 20, having two seamlines 22, permits to define a seat 31 which is adapted to receive the ends of the articles to be wrapped, which, in the example shown in FIGS. 3, 4 and 5 is an end of a mattress 32.

The stretching of the stretchable members 12 and the particular seamline 22 on the corners of the lining 27 make it possible to provide a retaining corner as the lining is wrapped around the article concerned, together with a snug adhesion also to the sides of the article whereat no such stretchable members are provided.

The figures show the several stages for positioning a lining 27 onto a mattress 32.

As a matter of fact, in FIG. 3 the lining 27 is placed above the mattress 32 with the folds 20 downwards.

Subsequently, as best seen in FIG. 4, the end of the mattress is slipped into the seat 31 and once snugly fit therein, through a small opening 33 in the seam, the stretchable member 12 sliding with its central shank within the sheath 18 is pulled, so as to latch the lining 27 onto the mattress 32 (FIG. 5).

In this mode of application, angular folds 34 remain outside the lining 27 as best seen in FIG. 5, but it is possible to act for having an application of a different kind (not shown).

As a matter of fact, the lining 27 in question could be placed above the mattress 32 but with the folds 20 pointing upward.

By means of the members 12 (elastics), pulled through the openings 33 and held fixed by appropriate means, the corners of the seatings 31 can be provided.

Figure 6:
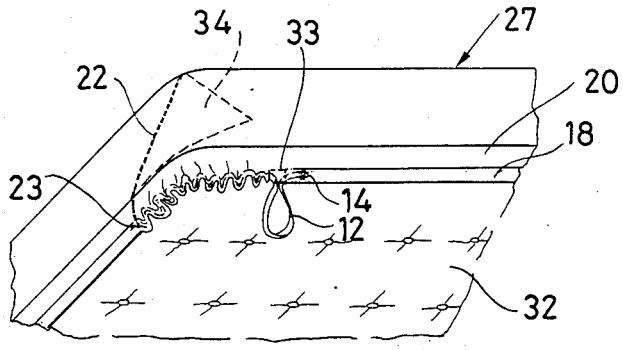
FIG. 6 shows the same lining as before but differently applied to a mattress.

At this stage, the folds 20 are turned upside down so that the angular edges 34 are brought into the interior of the lining 27 and the latter lining 27, is slipped, turned upside down, onto the mattress 32 (FIG. 6).

The angular folds 34, in an equivalent practical embodiment can be snipped away prior to finishing and folding the lining, by providing, additionally to the transversal severing means, 25, further cutting means (not shown in the drawings for the sake of simplicity).

It is apparent that the lining 27, after having removed the fastenings for the elastic band 12, reverts to a quite planar configuration so that the upkeep operations referred to above can safely be carried out.

In addition, and as diagrammatically shown in dot and dash lines in FIG. 2, the ends of the stretchable members 12 pointing towards the interior of the fabric piece, instead of being sewn at 14 at the piece can be interlocked by a nonresilient member, for example a ribbon 35. By so doing, as the bedsheet is applied, by the agency of the interlock member 35, the pull of the stretchable members 12 is caused to occur and, as a result, the corrugation of the respective sliding sheaths 18.

An article made by the method according to the invention, as it is clearly apparent from the example shown herein, affords the following advantageous features.

The method for manufacturing such removable linings makes it possible to provide a continuous production line which is entirely mechanized with the automation of the relative functions.

The article, that is the lining, permits to simplify the upkeep especially when made with mechanical pressing and folding machinery, and storage of such linings is easy, in addition to the incontestable advantages of a great ease of application to and removal of the lining from the article concerned, a very satisfactory adaption also to different shapes being warranted, while concurrently providing a reliable fastening during use.

What is claimed is:

1. An adjustable fitted sheet, comprising:

a substantially quadrilateral piece of cut fabric, one edge of which is formed into an edge-fold having at least one substantially perpendicular corner at an end thereof, said edge-fold including a stitched sheath provided at said end and extending parallel to said edge and gathering means provided within said sheath, said sheet further comprising a stitch line extending substantially diagonally across said corner and joining said edge-fold to said sheet, said stitch line further securing a first end of said gathering means within said sheath substantially about said edge-fold end.

2. An adjustable fitted sheet, as recited in claim 1, wherein an aperture is provided in said sheath at a distance from said edge-fold end beyond said stitch line and wherein said gathering means may be withdrawn from said sheath to gather said sheet about a tridimensional object.

3. An adjustable fitted sheet, as recited in claim 2, wherein another end of said gathering means is secured by securing means to said sheet at a position substantially about said aperture.

4. An adjustable fitted sheet, as recited in claim 3, wherein said securing means comprises stitchings.

5. An adjustable fitted sheet, as recited in claim 3, wherein said securing means comprises means for functionally connecting the gathering means of opposite edge-folds.

6. An adjustable fitted sheet, as recited in claim 3, wherein said gathering means comprises an elastic material.

7. An adjustable fitted sheet, as recited in claim 2, wherein said corner, said sheath, said gathering means and said stitch line are similarly provided at both ends of the edge-fold.

8. An adjustable fitted sheet, as recited in claim 7, wherein parallel edge-folds are provided on opposite edges of said sheet, each of said edge-folds including similar ones of said corner, said stitched sheath, said gathering means, and said stitch line at opposite ends thereof.

9. An adjustable fitted sheet, as recited in claim 1, wherein a seating portion is formed between said stitch line and said edge fold.

* * * * *